US006079957A

United States Patent [19]

Jirele

[11] Patent Number: 6,079,957

[45] Date of Patent: Jun. 27, 2000

[54] SOFT START VALVE

[75] Inventor: James E. Jirele, Owatonna, Minn.

[73] Assignee: SPX Corporation, Muskegon, Mich.

[21] Appl. No.: 09/193,558

[22] Filed: Nov. 17, 1998

[51] Int. Cl.[7] ..... F04B 49/00

[52] U.S. Cl. ..... 417/295; 417/206; 417/289; 417/53; 123/531; 123/179.31; 137/495; 137/599.2; 137/383

[58] Field of Search ..... 60/473, 468, 494; 123/531, 556, 179.31; 137/383, 495, 599.2, 493.3; 91/361; 417/53, 206, 295, 310; 303/114

[56] References Cited

U.S. PATENT DOCUMENTS

| | | | |
|---|---|---|---|
| 3,772,889 | 11/1973 | Mason et al. | 60/473 |
| 4,389,167 | 6/1983 | Farr | 417/289 |
| 4,662,825 | 5/1987 | Djordjevic | 417/206 |
| 4,674,805 | 6/1987 | Leiber | 303/114 |
| 4,731,999 | 3/1988 | Niemiec | 60/468 |
| 4,911,615 | 3/1990 | McCullagh | 417/295 |
| 4,915,126 | 4/1990 | Gyllinder | 137/495 |
| 5,088,467 | 2/1992 | Mesenich | 123/531 |
| 5,199,855 | 4/1993 | Nakajima et al. | 417/295 |
| 5,492,450 | 2/1996 | Bearint et al. | 417/295 |
| 5,540,558 | 7/1996 | Harden et al. | 417/53 |
| 5,542,384 | 8/1996 | Rosenmann et al. . | |
| 5,584,224 | 12/1996 | Davies et al. | 91/361 |
| 5,699,829 | 12/1997 | Weller, Jr. et al. . | |
| 5,911,239 | 6/1999 | Barthalow et al. | 137/599.2 |

*Primary Examiner*—Teresa Walberg
*Assistant Examiner*—L. Fastovsky
*Attorney, Agent, or Firm*—Hovey, Williams, Timmons & Collins

[57] ABSTRACT

A fluid pumping apparatus (10) includes a soft start valve (16) coupled with the outlet of a pump (14) driven by an electric motor (12) for reducing the startup current of the motor (12). The preferred valve (16) includes a fluid chamber (32), a valve operator in the nature of a ball (22) shiftable in the chamber (32) between the inlet (36) and a valve seat (48), and a biasing assembly (24) including an axially shiftable rod (54) and a spring (56) for biasing the rod (54) against the ball (22) in order to bias the ball (22) toward the chamber inlet (36). Upon startup, the valve (16) provides a reduced start pressure, less than the pump pressure under load, at the inlet (36) as the operator (22) moves toward the seat (48). The chamber (32) presents a volume sufficient for the valve (16) to provide the start pressure long enough for the motor (12) to achieve synchronous speed, thereby reducing motor startup current.

26 Claims, 1 Drawing Sheet

SOFT START VALVE

RELATED APPLICATIONS

Not applicable.

FEDERALLY SPONSORED RESEARCH OR DEVELOPMENT

Not applicable.

MICROFICHE APPENDIX

Not applicable.

BACKGROUND OF THE INVENTION

1. Field of the Invention

The present invention relates to the field of pumping systems. In particular, the invention is concerned with an hydraulic pumping system having a soft start valve coupled with a pump outlet to provide reduced start pressure in order to reduce startup current of the electric motor coupled with the pump.

2. Description of the Prior Art

In a fluid pumping system, such as a hydraulic pump driven by an electric motor, the motor experiences high startup current until it achieves substantially synchronous speed. The startup current is even higher when the system starts with the pump under load or when low voltage conditions are present. High startup currents can overload circuits causing nuisance trips of the power supply.

Also, induction motors typically develop a startup torque that is lower than the synchronous speed running torque. For applications where the motor must start under full load, the load must be sized so that it does not exceed the available startup torque. In these instances the full running torque capability cannot be utilized. For a given load, a larger motor must be used to provide sufficient startup torque.

SUMMARY OF THE INVENTION

The present invention solves the prior art problems discussed above and provides a distinct advance in the state of the art. In particular, the soft start valve hereof reduces the motor startup current in a fluid pumping system in a manner that is economical to manufacture, simple to install and reliable in use.

The preferred fluid pumping system in accordance with the present invention includes a soft start valve coupled with the outlet of a pump driven by an electric motor for reducing the startup current of the motor. The preferred valve includes a fluid chamber, a valve operator in the nature of a ball shiftable in the chamber between the inlet and a valve seat, and a biasing assembly including an axially shiftable rod and a spring for biasing the inboard end of the rod against the ball in order to bias the ball toward the chamber inlet. Upon startup, the valve provides a reduced start pressure, less than the pump pressure under load, as the valve operator moves toward the seat. The chamber presents a volume sufficient for the valve to provide the reduced start pressure long enough for the motor to achieve substantially synchronous speed, thereby reducing motor startup current. Other preferred aspects of the invention are disclosed herein.

DETAILED DESCRIPTION OF THE PREFERRED EMBODIMENT

Figure 1:
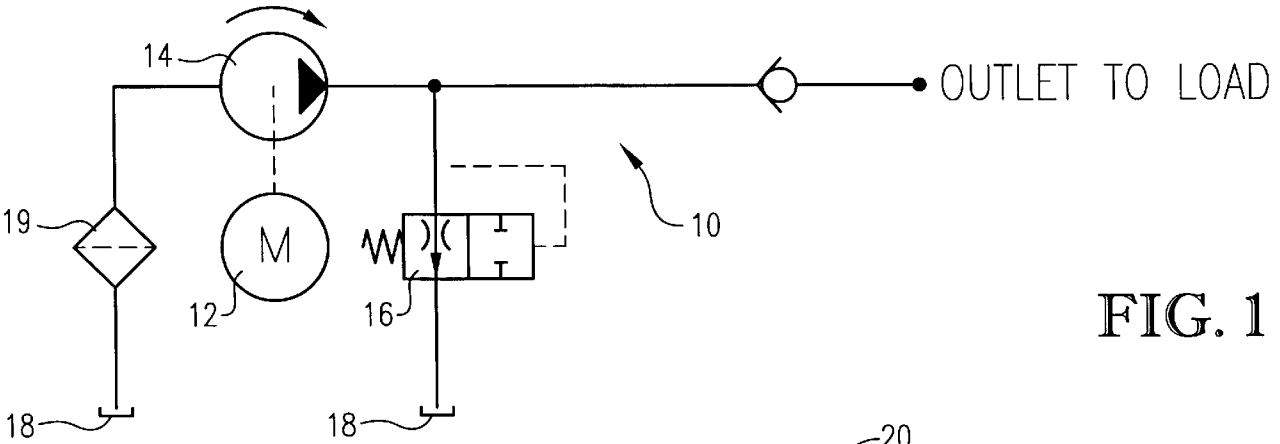
FIG. 1 is a schematic illustration of the preferred pumping system in accordance with the present invention.

FIG. 1 illustrates preferred pumping apparatus 10 in accordance with the present invention. In the preferred embodiment, apparatus 10 is an hydraulic pumping system including electric motor 12 coupled with hydraulic pump 14 for operation thereof, soft start valve 16 fluidically coupled with outlet of pump 14, and reservoir 18 coupled with the inlet of pump 14 with inlet filter 19 therebetween. Reservoir 18 is also coupled with soft start valve 16.

Figure 2:
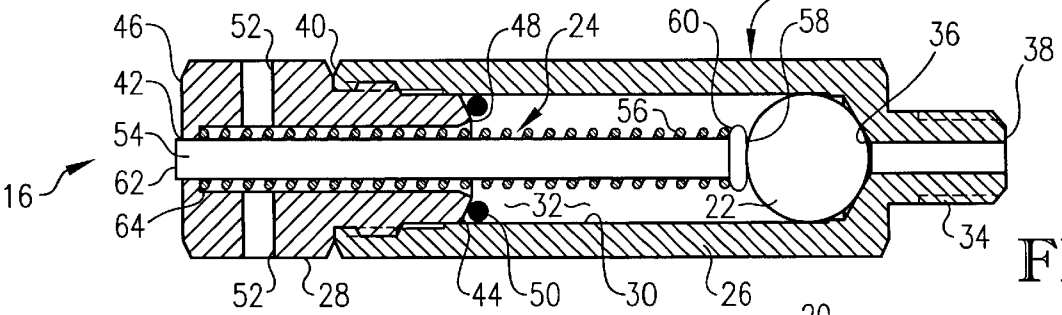
FIG. 2 is a side sectional view of the preferred soft start valve of FIG. 1 showing the valve in the unactuated position.
Figure 3:
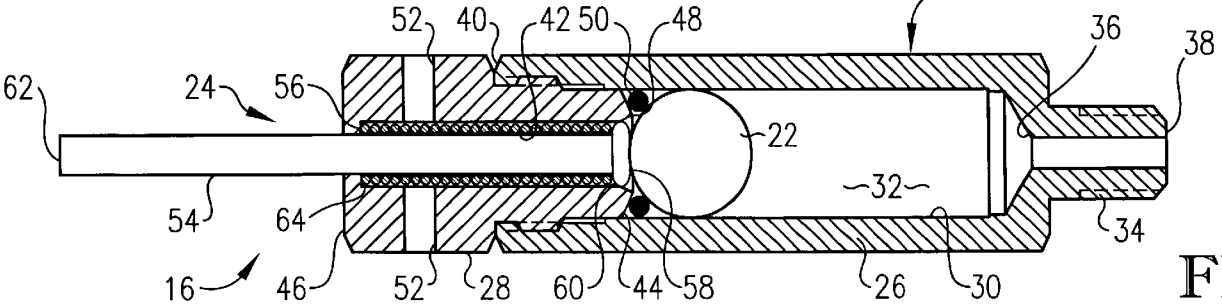
FIG. 3 is a view similar to FIG. 2 showing the valve in the actuated position.

Referring to FIGS. 2 and 3, soft start valve 16 includes valve body 20, a valve operator in the nature of ball 22, and biasing assembly 24. Valve body 20 includes chamber section 26 and seat section 28.

Chamber section 26 presents a generally tubular configuration and includes chamber walls 30 defining cylindrically shaped chamber 32. Walls 30 are also configured to present inlet nipple 34 defining chamber inlet 36 at inlet end 38, and opposed end 40 opposite inlet 36. Nipple 34 is connected to the outlet piping from pump 14 thereby fluidically coupling inlet 36 with the outlet of pump 14.

Seat section 28 presents a tubular configuration defining rod passage 42. Section 28 includes connection end 44 received and coupled in opposed end 40 of chamber section 26 and distal end 46. Connection end 44 is configured to present valve seat 48 and to support O-ring 50 surrounding the inboard end of passage 42 and against chamber walls 30.

Ball 22 is positioned in chamber 32 and sized to shift between chamber inlet 36 and valve seat 48. Chamber walls 30 and ball 22 are configured to provide a fluid seal therebetween.

Seat section 28 also includes weep holes 52 defined therethrough adjacent distal end 46 and connected to passage 42. Holes 52 allow discharge of fluid that may pass by ball 22 and enter passage 42 and are fluidically coupled with reservoir 18 for receipt of such weep discharge.

Biasing assembly 24 includes rod 54 extending through rod passage 42 and axially shiftable therein and further includes spring 56. Rod 54 includes inboard end 58, presenting a somewhat mushroom shape, configured to engage ball 22 and to present shoulder 60. Rod 54 also includes outboard end 62 that extends through passage 42 and is positioned outboard of seat section 28.

Spring 56 is in the nature of a coiled, compression spring received about rod 54, and extends between shoulder 60 of rod 54 and spring seat 64 located in passage 42 just inside distal end 46. As shown in FIGS. 2 and 3, spring 56 pushes against shoulder 60 to bias rod 54 and thereby bias ball 22 toward inlet 36. The compression force of spring 56 is selected to bias ball 22 to provide a back pressure in the nature of a start pressure at inlet 36 so that the start pressure is less than the pump pressure of pump 14 under load. For example, spring 56 can be selected to provide a start pressure of about 25 psi in the unactuated position of valve 16 illustrated in FIG. 2, which gradually increases to about 50 psi in the actuated position of FIG. 3 as spring 56 is compressed. As will be appreciated, the compression force of spring 56 can be selected as needed for a particular application.

On startup of apparatus 10, electric motor 12 is energized and draws substantial startup current. Without the provision of soft start valve 16, the pump pressure under load of pump 14 could be in the range of 3500 psi., for example. The operation of valve 16, however, relieves this startup pressure by providing a substantially reduced startup pressure, e.g. 25 psi.

In particular, when motor 12 begins to turn pump 14, hydraulic fluid from the discharge thereof is shunted by way of valve inlet 36 into chamber 32 and against ball 22, as shown in FIG. 2. As the pressure from pump 14 increases, ball 22 shifts from inlet 36 toward valve seat 48 against the bias of spring 56. This limits the pressure on the outlet of pump 14 to the start pressure until ball 22 engages valve seat 48 and O-ring 50 in the actuated position shown in FIG. 3.

When ball 22 is seated, chamber 32 is filled with fluid and valve 16 no longer limits the pressure from the outlet of pump 14. However, chamber 32 presents a volume sufficient for valve 16 to provide the start pressure long enough for motor 12 to begin rotation in order to reduce the startup current. In the preferred embodiment, the volume of chamber 32 is sufficient for motor 12 to achieve substantially synchronous speed, about 5 to 10 revolutions. For example, the volume of chamber 32 could be between 0.5 and 0.75 cubic inches. It will be appreciated that even a smaller volume may be sufficient to substantially reduce the startup current because the highest startup current occurs immediately when motor 12 is energized and then reduces as synchronous speed is approached.

Those skilled in the art will appreciate that the present invention encompasses many variations in the preferred embodiment described herein. For example, the invention finds utility for other fluids in addition to the preferred hydraulic. Also, the bias on the valve operator and the volume of the chamber of the soft start valve can be varied as needed for a particular application. Having thus described this embodiment, the following is claimed as new and desired to be secured by Letters Patent:

What is claimed is:

1. A soft start valve for use with a fluid pump coupled with an electric motor for operation thereby, the pump having a pump outlet and operable to generate a pressure under load at the outlet, the motor being subject to startup current upon startup to operate the pump, said valve comprising:

a valve body having walls defining a fluid chamber having an inlet configured for fluidically coupling with the pump outlet to receive fluid therefrom and defining a valve seat spaced from said inlet;

a valve operator positioned in said chamber and shiftable therein between said inlet and said seat, said operator and walls being configured to provide a fluid seal therebetween; and biasing means biasing said operator towards said inlet to provide a start pressure, less than the pump pressure under load, at said inlet and thereby at said pump outlet during startup and during shifting of said operator toward said seat, said chamber presenting a volume sufficient for said valve to provide said start pressure long enough for the motor to begin rotation during startup in order to reduce the startup current.

2. The valve of claim 1, said fluid including hydraulic fluid.

3. The valve of claim 1, said chamber presenting a cylindrical configuration with said inlet adjacent one end and said seat adjacent the opposed thereof.

4. The valve of claim 3, said operator including a ball.

5. The valve of claim 4, said biasing means including an axially shiftable rod extending through said opposed end of said chamber, said rod including an inboard end configured to engage said ball, said ball being positioned between said inlet and said inboard end, and including a spring coiled about said rod and configured to bias said inboard end toward said inlet and thereby bias said ball toward said inlet.

6. The valve of claim 5, said chamber presenting a volume sufficient for said valve to provide said start pressure long enough for the motor to turn at least five revolutions.

7. The valve of claim 5, said chamber presenting a volume sufficient for said valve to provide said start pressure long enough for the motor to achieve substantially synchronous speed.

8. The valve of claim 5, said start pressure being between about 25 and 50 psi.

9. The valve of claim 5, said chamber presenting a volume of between about 0.5 and 0.75 cubic inches.

10. The valve of claim 1, said chamber presenting a volume sufficient for said valve to provide said start pressure long enough for the rotor to turn at least five revolutions.

11. The valve of claim 1, said chamber presenting a volume sufficient for said valve to provide said start pressure long enough for the rotor to achieve substantially synchronous speed.

12. The valve of claim 1, said start pressure being between about 25 and 50 psi.

13. The valve of claim 1, said chamber presenting a volume of between about 0.5 and 0.75 cubic inches.

14. In combination:

a fluid pump having a pump outlet and operable to generate a pressure under load at said outlet;

an electric motor coupled with said pump for operation thereof, said motor being subject to startup current upon startup to operate said pump; and a soft start valve including a valve body having walls defining a fluid chamber having an inlet configured for fluidically coupling with said pump outlet to receive fluid therefrom and defining a valve seat spaced from said inlet, a valve operator positioned in said chamber and shiftable therein between said inlet and said seat, said operator and walls being configured to provide a fluid seal therebetween, and biasing means biasing said operator towards said inlet to provide a start pressure, less than the pump pressure under load, at said inlet and thereby at said pump outlet during startup and during shifting of said operator toward said seat, said chamber presenting a volume sufficient for said valve to provide said start pressure long enough for the motor to begin rotation during startup in order to reduce the startup current.

15. The valve of claim 14, said fluid including hydraulic fluid.

16. The valve of claim 14, said chamber presenting a cylindrical configuration with said inlet adjacent one end and said seat adjacent the opposed thereof.

17. The valve of claim 16, said operator including a ball.

18. The valve of claim 17, said biasing means including an axially shiftable rod extending through said opposed end of said chamber, said rod including an inboard end configured to engage said ball, said ball being positioned between said inlet and said inboard end, and including a spring coiled about said rod and configured to bias said inboard end toward said inlet and thereby bias said ball toward said inlet.

19. The valve of claim 18, said chamber presenting a volume sufficient for said valve to provide said start pressure long enough for the motor to turn at least five revolutions.

20. The valve of claim 18, said chamber presenting a volume sufficient for said valve to provide said start pressure long enough for the motor to achieve substantially synchronous speed.

21. The valve of claim 18, said start pressure being between about 25 and 50 psi.

22. The valve of claim 18, said chamber presenting a volume of between about 0.5 and 0.75 cubic inches.

23. The valve of claim 14, said chamber presenting a volume sufficient for said valve to provide said start pressure long enough for the rotor to turn at least five revolutions.

24. The valve of claim 14, said chamber presenting a volume sufficient for said valve to provide said start pressure long enough for the rotor to achieve substantially synchronous speed.

25. The valve of claim 14, said start pressure being between about 25 and 50 psi.

26. The valve of claim 14, said chamber presenting a volume of between about 0.5 and 0.75 cubic inches.

* * * * *